United States Patent [19]

Barrett

[11] Patent Number: 4,799,672

[45] Date of Patent: Jan. 24, 1989

[54] POWERLIFT COMPETITION SAFETY DEVICE

[76] Inventor: William L. Barrett, 295 Maplewood Ave., Whitehall, Ohio 43213

[21] Appl. No.: 140,622

[22] Filed: Jan. 4, 1988

[51] Int. Cl.[4] ..... A63B 13/00

[52] U.S. Cl. ..... 272/123; 272/130

[58] Field of Search ..... 272/117, 123, 130, 134, 272/DIG. 7

[56] References Cited

U.S. PATENT DOCUMENTS

| | | | |
|---|---|---|---|
| 3,451,271 | 6/1969 | Knoblauch | 272/130 X |
| 3,998,100 | 12/1976 | Pizatella | 272/130 X |
| 4,540,171 | 9/1985 | Clark et al. | 272/123 X |
| 4,709,922 | 12/1987 | Slade, Jr. et al. | 272/123 |
| 4,750,739 | 6/1988 | Lange | 272/123 X |

FOREIGN PATENT DOCUMENTS

| | | | |
|---|---|---|---|
| 2029243 | 3/1980 | United Kingdom | 272/130 |
| 86/06644 | 11/1986 | World Int. Prop. O. | 272/130 |

*Primary Examiner*—V. Millin
*Assistant Examiner*—Robert W. Bahr
*Attorney, Agent, or Firm*—Mueller and Smith

[57] ABSTRACT

A weightlifting apparatus operable to support a barbell comprising a pair of spaced-apart, substantially parallel vertical support members, each having an upper end and a lower end. A base supports the support members. Each support member bears synchronously and selectively movable, horizontally projecting spotting arms which are disposed in substantially the same horizontal plane. These support members are adapted to receive the barbell. Each spotting arm is coupled with a rod and cylinder assembly and each assembly is fluid actuable for synchronous movement of said spotting arms. An actuator or switch is provided for actuating said assemblies.

6 Claims, 4 Drawing Sheets

POWERLIFT COMPETITION SAFETY DEVICE

BACKGROUND OF THE INVENTION

The dramatic increase in the popularity of powerlifting has brought a concomitant rise in injuries resulting from competition lifts over 800 pounds. Powerlift competition involves three lifts: the bench press, the dead lift, and the squat lift, each of which carries its own risk of harm. The bench press is dangerous because a failed lift may cause the barbell to crush the competitors chest were spotters not present to relieve the weight. The most dangerous lift, however, is the squat lift in which a competitor places the barbell across his shoulders, steps forward from the rack, and squats until his thighs are parallel to the floor. Because the barbell rests on the competitor's shoulders he cannot merely drop it aside if he is unable to make the lift as he can in a dead lift. The two particularly dangerous portions of the squat lift are the step forward to clear the rack, and the actual squat. One lifter who failed with a 750 pound squat broke leg bones and tore leg muscles. The spottres have a particularly difficult time with the squat lift not only because the barbell is moving downward as opposed to upward in the bench press situation, but also because the barbell is being moved a greater distance, first out from the rack and then down to the squat position. While these problems are particularly acute in a competitive setting because of the incredible weight being lifted, similar problems occur to a lesser degree in all exercise gyms and recreation facilities.

U.S. Pat. No. 4,249,726 discloses two embodiments of a bench press safety device. The first utilizes an electromechanical jack to, in effect, catch the barbell on a failed lift, and the second utilizes a hand-operated hydraulic jack to set a counter-weight which will relieve the exerciser of the barbell in case of a failed lift. U.S. Pat. No. 4,253,662 discloses a weogjt;oftomg safety apparatus which utilizes a counter-weight and electrical motor to relieve a failed lift. U.S. Pat. No. 4,324,398 and U.S. Pat. No. 4,420,154 disclose weightlifting safety apparati which utilize mechanical stops to arrest the fall of the barbell in the case of a failed lift. U.S. Pat. No. 4,650,186 discloses a bench press safety device permitting the exerciser to relieve the barbell with the strength of their legs. None of these prior inventions disclose a safety device adequate for the needs of competition powerlifting. A powerlift safety device must be able to repeatedly "spot" or arrest the fall of a 1,000 or more pound barbell, permit lateral mobility to accommodate a particular weightifter's style, and allow the barbell to be free from cables, chains, and the like often utilized for safety purposes.

SUMMARY OF THE INVENTION

In addressing the peculiar needs of powerlift competitors, the safety device of the present invention is a simple, yet elegant solution to the safety requirements of recreational lifters as well.

In contravention of recent prior art disclosure, for example U.S. Pat. No. 4,615,524, hydraulic jacks form the ideal core for a weightlifting safety device. The present invention utilizes hydraulic jacks, one in each vertical support member, which operate synchronously without the need for mechanical interconnection of the two vertical support members. This not only reduces the bulk of the safety device thereby increasing transportability, but also reduces the power requirements thereby permitting battery, or other transportable power source, operation. Further, hydraulic apparati generally require much less maintenance than electromechanical apprati because of the frictions and moments associated with any combination of moving parts. The only moving parts in the present invention are a sheave and rollers, both of which may be provided as selflubricating.

The invention also makes advantageous use of the strength of hydraulic jacks by utilizing a 1-for-2 mechanical disadvantage in order to increase the velocity of the spotter by obtaining a 42 inch travel of the spotter arm with a 21 inch stroke hydraulic jack. Additionally, this extended spotter travel permits the device to be utilized in both bench press and squat lift exercises.

Other objects of the invention will, in part, appear hereinafter.

The invention, accordingly, comprises the apparatus possessing the construction, combination of elements and arrangement of parts which are exemplified in the following disclosure. For a fuller understanding of the nature and object of the invention, reference should be had to the following detailed description taken in connection with the accompanying drawings.

DETAILED DESCRIPTION OF THE INVENTION

All prior weightlifting safety devices suffer one or more defects making them unfit for use in powerlift competition. The rules of powerlift competition require that lifts be made with free weights, that is barbells free of safety chains or cables as well as other racks constricting lateral movement of the barbell. Further, with many lifts in powerlift competition approaching 1,000 or more pounds the utility of counter-weight safety devices as well as mechanical stops is limited. Counterweight systems eliminate the roll for spotters, but require individuals to set the counter-weight for each lift.

Figure 1:
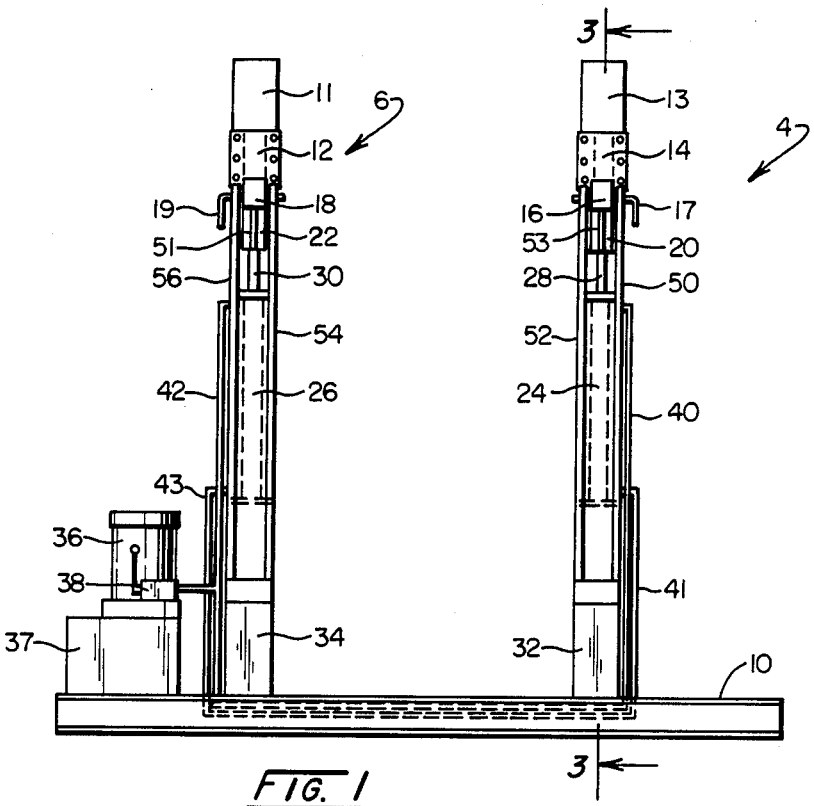
FIG. 1 is a front elevational view of the apparatus.
Figure 2:
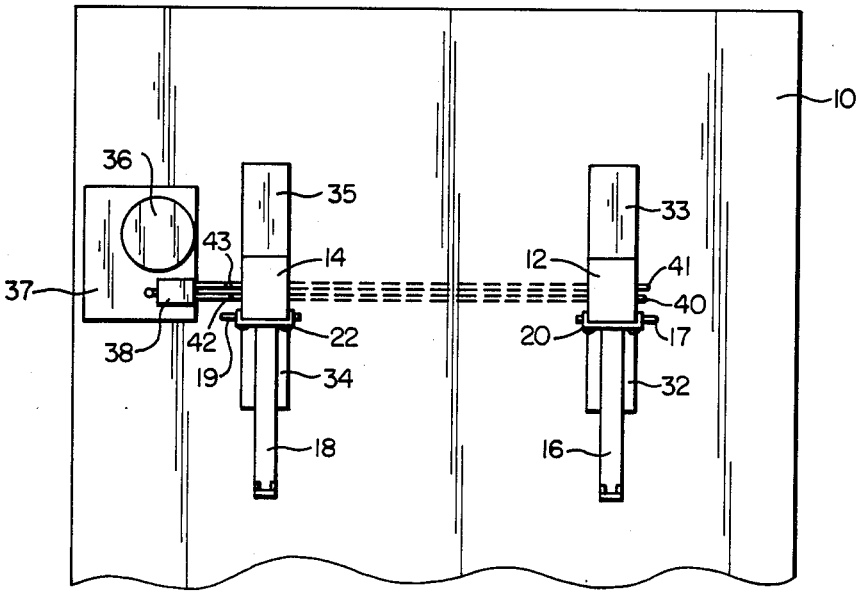
FIG. 2 is a top plan view of the apparatus.
Figure 3:
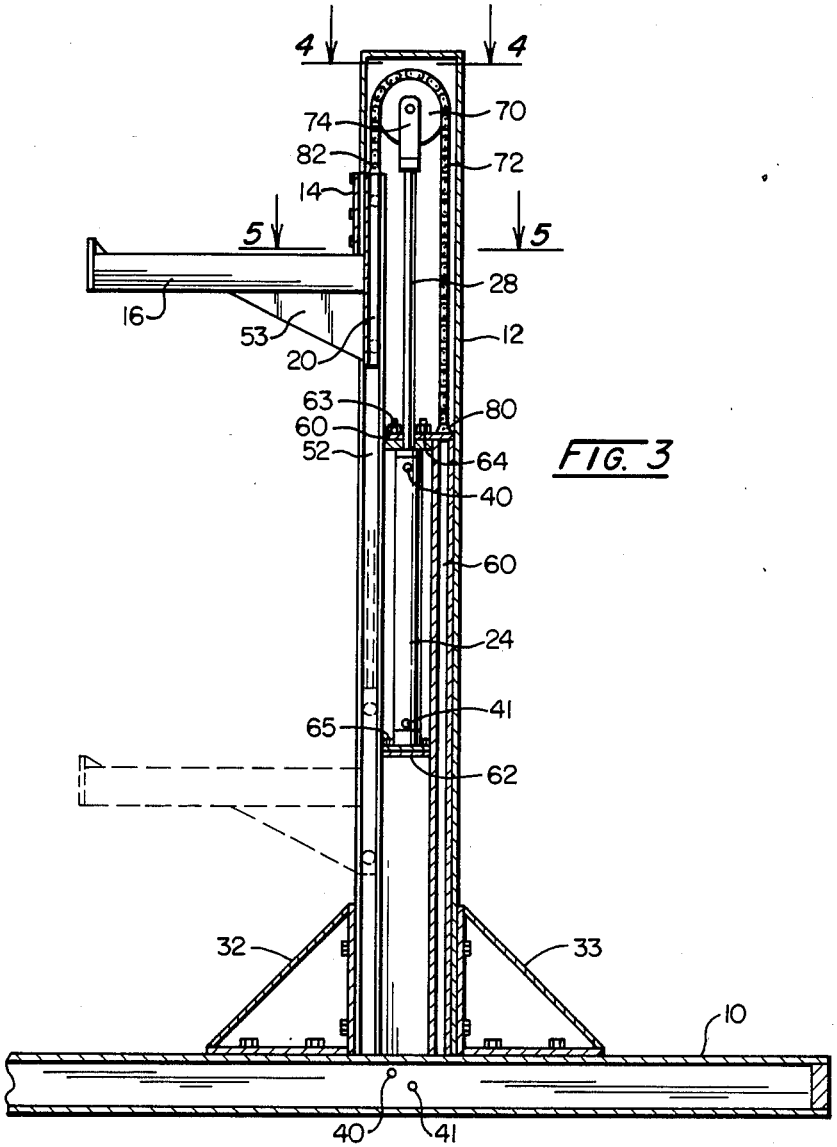
FIG. 3 is a side elevational view of the apparatus.

FIG. 1 depicts generally a front view of the weightlifting safety device of the present invention, consisting mainly of a plywood base 10 with non-slip surface and two vertical support members 4 and 6 bolted thereto by means of triangular support brackets 32 and 34 shown and 33 and 35 acting as tie plates (see FIGS. 2 and 3). Another embodiment might find the vertical support members fixed more or less permanently to the wall or floor, however, the preferred embodiment for competitive lifting emhances transportability. Horizontal spotting arms 16 and 18 are welded to triangular brackets 53 and 51, respectively, and to weight support carriages 20 and 22 respectively. The weight support carriages contain rollers (see FIGS. 4 and 5) which travel in inwardly facing U-shaped rails 50, 52, 54, and 56 attached to vertical support members 4 and 6 by tie plates 12 and 14. Safety pins 17 and 19 are removable and utilized to support the weight carriage assembly when the hydraulic jack is not in use. Hydraulic pump 36, reservoir 37, and pump valve 38 are shown connected to hydraulic cylinders 26 and 24 via hydraulic lines 40, 41, 42 and 43. In operation, hydraulic cylinders 24 and 26 adjust the height of weight carriage assemblies 20 and 22 by means hydraulic cylinder rods 28 and 30, a lift chain not shown in this view, and a sheave not shown in this view. Safety covers 11 and 13 shield this mechanism from the user.

FIG. 2 shows a top plan view of the present invention with the only additional detail being rearward triangular support brackets 33 and 35.

FIG. 3 depicts the cross-section of vertical support member 4 as shown in FIG. 1. Hydraulic cylinder 24 is seen supported within vertical support member 4 by means of retaining plates 62 and 64, and arrays of machine bolts 63 and 65. Hydraulic rod 28 is shown attached to lift chain sheave 70 by means of bolt and bracket 74. Lift chain 72 is seen affixed to vertical support member 4 by lug and pin assembly 80 on reinforcing support 60, and to weight support carriage 20 by means of lug and pin assembly 82. By affixing lift chain 72 in this manner, the 21-inch travel of hydraulic rod 28 enables a 42 inch travel of weight support carriage assembly 20 with attached spotting arms 16. The resultant increased strength requirements are inconsequential for the hydraulic cylinder, but permit recovery of the barbell in a failed attempt at twice the velocity of a system where the hydraulic cylinder directly displaces the weight support carriage. Ingress and egress ports for hydraulic fluid are also shown in hydraulic cylinder 24 as well as non-slip plywood base 10. Also depicted is the orientation of the inwardly facing U-shaped rails in which travels the weight support carriage. The cross-section of FIG. 3 depicts U-shaped rail 52 inwhich travels onehalf the bearings of weight support carriage 20.

Figure 4:
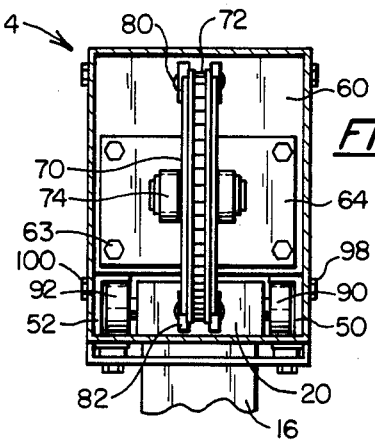
FIGS. 4 and 5 are sectional views of a vertical support member at the planes shown in FIG. 3.

FIG. 4 depicts the alignment of parts and details of construction within vertical support member 4 from a top view with safety cover 13 removed. Additional mechanical details include a partial view of inwardly facing U-shaped rails 50 and 52, and weight carriage assembly rollers 90 and 92 positioned therein.

Figure 5:
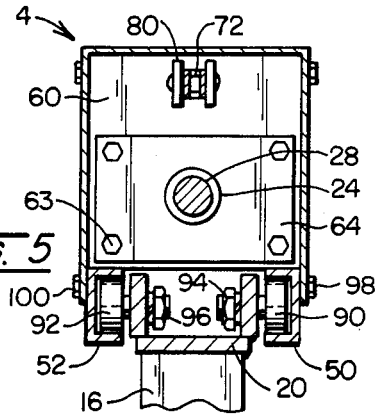

FIG. 5 depicts a cross-sectional view of vertical support member 4. The position and function of inwardly-facing U-shaped rails 50 and 52 is clearly shown in this view as are the rollers 90 and 92 which travel therein, thereby translating the weight support carriage. Rollers 90 and 92 are attached to weight support carriage 20, and thereby to spotting arm 16, by axle bolts 94 and 96. The inwardly facing U-shaped rails 50 and 52 are welded to retaining plates 62 and 64 and attached to the vertical support member 4 by means of a dual series of self-tapping sheet metal screws depicted singularly at 98 and 100. Each weight carriage assembly 20 contains four rollers aligned in two vertical pairs, each pair traveling in one U-shaped rail. In this regard, two rollers identical to the roller depicted 90 and 92 lie below 90 and 92.

Figure 6:
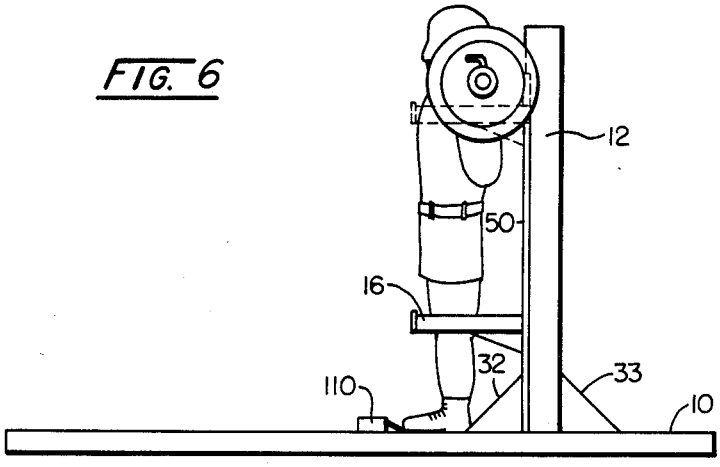
FIGS. 6 and 7 are side views of the apparatus in use as a squatlift spotter.
Figure 7:
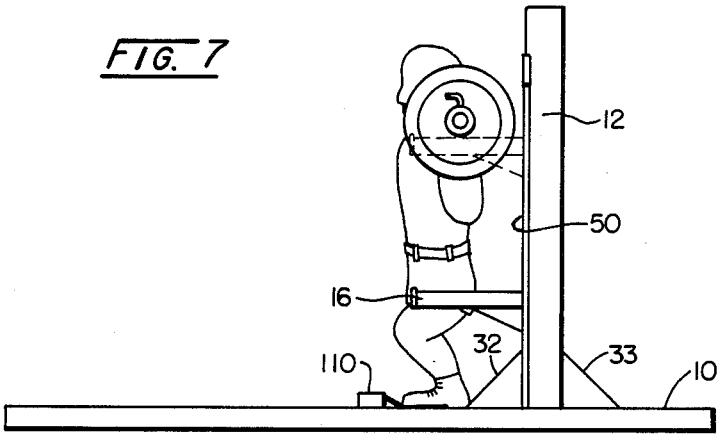
Figure 8:
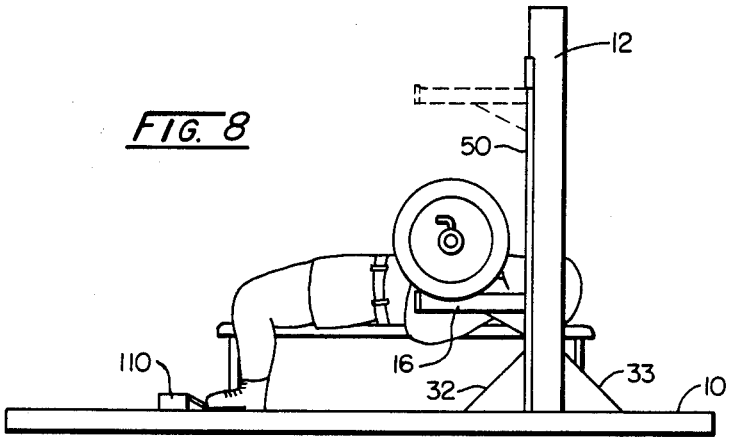
FIG. 8 is a side view of the apparatus in use as a bench press spotter.

FIGS. 6 and 7 show the present invention being used as a squat lift safety device. Also in both FIGS. 6 and 7 the safety device is shown actuable by a foot switch 110, however in competition the safety device would be actuable by the referee. Notice that the squat lift competitor need not take a step forward to clear the barbell from the rack, thereby eliminating one of the more dangerous steps in the squat lift which is not required for completion but merely because of prior limitations in equipment. In operation, the referee, exerciser, or exercise partner, actuates the spotting switch to turn on the hydraulic pump. As the pressure in the hydraulic lines increases, the rod and attached sheave are forced out of the cylinder upwardly to draw up the chain and attached weight support carriage.

I claim:

1. A weightlifting apparatus operable to support a barbell comprising:

(a) a pair of spaced-apart, substantially parallel vertical support members, each having an upper end and a lower end;

(b) a base supporting said support members;

(c) each said support member bearing synchronously and selectively movable, horizontally projecting spotting arms which are disposed in substantially the same horizontal plane and are adapted to receive a barbell;

(d) a rod and cylinder assembly coupled to each of said spotting arms, said coupling substantially situated in said upper ends of each of said support member and said assemblies being fluid actuable for synchronous movement of said spotting arms, wherein said coupling means includes a weight support carriage affixed to each said spotting arm, a lift chain affixed to each said weight support carriage and each said support member, and a sheave affixed to each of said rods, said lift chain being trained about said sheave; and, (e) an actuating means for said assemblies, said assemblies being fluid actuable for synchronous movement of said spotting arms.

2. The weightlifting apparatus of claim 1 wherein each said weight support carriage bears rollers for travel along each said support member.

3. The weightlifting apparatus of claim 2 wherein said rollers of each said weight support carriage travel along rails affixed to each said support member.

4. The weightlifting apparatus of claim 1 wherein said assemblies actuate synchronously by means of interconnected fluid lines and a single pump.

5. The weightlifting apparatus of claim 4 wherein said actuating means is actuable by a person using said apparatus.

6. The weightlifting apparatus of claim 4 wherein said actuating means is remotely located therefrom.

* * * * *